US010376939B2

(12) United States Patent
Vielhaber

(10) Patent No.: US 10,376,939 B2
(45) Date of Patent: Aug. 13, 2019

(54) TOOL UNIT, EXTRUSION MACHINE, AND METHOD FOR CHANGING A FRICTION WHEEL

(71) Applicant: ASMAG-Holding GmbH, Gruenau im Almtal (AT)

(72) Inventor: Johann Vielhaber, Gruenau im Almtal (AT)

(73) Assignee: ASMAG-Holding GmbH, Gruenau im Almtal (AT)

( * ) Notice: Subject to any disclaimer, the term of this patent is extended or adjusted under 35 U.S.C. 154(b) by 489 days.

(21) Appl. No.: 15/037,096

(22) PCT Filed: Nov. 17, 2014

(86) PCT No.: PCT/AT2014/050274
§ 371 (c)(1),
(2) Date: Aug. 19, 2016

(87) PCT Pub. No.: WO2015/070274
PCT Pub. Date: May 21, 2015

(65) Prior Publication Data

US 2016/0361743 A1 Dec. 15, 2016

(30) Foreign Application Priority Data

Nov. 18, 2013 (AT) ..... 50765/2013

(51) Int. Cl.
*B21C 23/00* (2006.01)
*B21C 23/21* (2006.01)
*B21C 25/02* (2006.01)

(52) U.S. Cl.
CPC ..... *B21C 23/005* (2013.01); *B21C 23/212* (2013.01); *B21C 25/02* (2013.01)

(58) Field of Classification Search
CPC ..... B21C 23/005; B21C 23/212
See application file for complete search history.

(56) References Cited

U.S. PATENT DOCUMENTS 3,839,894 A * 10/1974 Kent ..... B21C 23/212 72/263
4,598,567 A * 7/1986 Backus ..... B21C 23/005 72/262

(Continued)

FOREIGN PATENT DOCUMENTS

CN 101733298 A 6/2010
CN 102294377 A 12/2011

(Continued)

OTHER PUBLICATIONS

International Search Report of PCT/AT2014/050274, dated Jul. 29, 2016.

*Primary Examiner* — Debra M Sullivan
(74) *Attorney, Agent, or Firm* — Collard & Roe, P.C.

(57) ABSTRACT

The invention relates to a tool unit (12) for an extrusion machine (1) with a scraping element (51), a tool element (49) with an expanding channel (50) receiving the scraped extrusion material (3) and a die (53). The tool unit (12) includes a receiving cage (42) with first and second receiving cage parts (43, 44). In the first receiving cage part (43) there is a tool element (49) inserted in a receiving channel (48). In the second receiving cage part (44) a receiving chamber (52) facing the first receiving cage part (43) is formed, in which at least the die (53) is received and supported by a support surface (56). In the tool element (49) as well as in the first receiving cage part (43) a common receiving groove (62) is formed with at least one groove base surface (63, 64), in which the scraping element (51) is inserted loosely and is supported. The invention also relates to an extrusion machine (1) as well as to a method for changing the friction wheel (4).

25 Claims, 7 Drawing Sheets

(56) References Cited

U.S. PATENT DOCUMENTS

| | | | |
|---|---|---|---|
| 4,823,586 | A | 4/1989 | Sinha et al. |
| 5,157,955 | A | 10/1992 | Hawkes et al. |
| 5,406,818 | A | 4/1995 | Linsenbardt et al. |
| 2014/0000332 | A1 | 1/2014 | Wilson et al. |

FOREIGN PATENT DOCUMENTS

| | | | |
|---|---|---|---|
| EP | 0 408 259 | B1 | 6/1994 |
| GB | 2 103 527 | A | 2/1983 |
| GB | 2 103 572 | A | 2/1983 |
| GB | 2 386 334 | A | 9/2003 |
| JP | S59-223113 | A | 12/1984 |
| JP | 2001-340915 | A | 12/2001 |
| JP | 2010-279960 | A | 12/2010 |
| WO | 95/07777 | A1 | 3/1995 |
| WO | 2012/119196 | A1 | 9/2012 |

* cited by examiner

TOOL UNIT, EXTRUSION MACHINE, AND METHOD FOR CHANGING A FRICTION WHEEL

CROSS REFRENCE TO RELATED APPLICATIONS

This application is the National Stage of PCT/AT2014/050274 filed on Nov. 17, 2014, which claims priority under 35 U.S.C. § 119of Austrian Application No. A 50765/2013 filed Nov. 18, 2013, the disclosure of which is incorporated by reference. The international application under PCT article 21 (2) was not published in English.

BACKGROUND OF THE INVENTION

1. Field of the Invention

The invention relates to a tool unit for an extrusion machine for a continuous manufacture of profiles from a moldable extrusion material, an extrusion machine as well as a method for changing a friction wheel of the extrusion machine.

2. Description of the Related Art

From the EP 0 408 259 B1 a device is known for continuous extrusion, which has a rotating wheel with a peripheral groove. The extrusion tool composed of several tool elements is inserted in a graduated intake opening of a tool holder supported on the base frame on a swivel axis. In the open position of the tool holder, the extrusion tool can be taken out of it in the ground-facing direction. The scraping element is held in the bolted and clamped position at the tool elements building the extrusion tool.

SUMMARY OF THE INVENTION

The task of the present invention is to create a tool unit, which forms a coherent structural unit, in which an easy exchange or replacement of tool components is possible and still a flawless support and positioning is possible during operation. A further and possibly independent task of the invention exists in the fact to create an extrusion machine, in which an easy adjustment is possible of the gap formed between the friction wheel and the tool unit. However, a method for changing the friction wheel of the extrusion machine should also be specified, which enables an easy accessibility to the friction wheel as well as in connection with it a short shutdown time can be achieved.

A first task of the invention is accomplished by the features of one aspect of the invention. The advantage resulting from the features of this aspect of the invention lies in the formation of a separate receiving cage for building the tool unit, in which the individual tool parts or tool components are received and are supported by it. This makes it possible to prepare the required individual components of the tool unit and to arrange them accordingly in the receiving cage for the respective profile to be made. Through the provision of the receiving cage with its receiving cage parts and the support of the die as well as the tool components arranged further one after the other in the direction of extrusion at the support area supporting the receiving area, an already corresponding load transfer can take place via the receiving cage to the tool holder of the extrusion machine. In this way, for instance, additional screw connections or other means of connection can be avoided. Attention only needs to be paid to a corresponding alignment of the individual tool components. Further, through the provision of the receiving groove for receiving the scraping element this can be laid in without additional fixing means with corresponding guiding accuracy and supported in the receiving groove for load transfer. This creates the possibility of easily being able to do an exchange or replacement in case of wear, without making additional and long-winding manipulation activities necessary while doing so.

Furthermore, the tool unit can thus be formed easily because of the use of the receiving cage with a predefined longitudinal stretch, as a result of which always the same installation conditions can be created for the tool holding device with respect to the longitudinal stretch in the direction of the discharge channel for the profile.

Advantageous is also another design form according to an embodiment of the invention. In this way, owing to the aligned groove base surfaces running up to each other, an exact positioning and holding of the scraping element can be enabled at the tool unit, in particular, the receiving cage as well as the tool element. In case of a corresponding selection of the angle thus an automatically acting support as well as holding and self-centering is achieved during running operation. Thus, the scraping element is pressed in the receiving groove as well as at the groove base surfaces and is firmly held there positioned despite the loose insertion.

Advantageous is further a formation according to another embodiment, because with this a still better positioning of the scraping element in the receiving groove can be achieved.

Through the formation according to another embodiment, it is possible to achieve an axial adjustment of the tool element arranged on the inlet side in the first receiving cage part and to do away with additional guide elements. With this, an axial adjustment can be achieved, without doing a rotation of the tool element relative with respect to the first receiving cage part.

According to another design variant, an axial guide is thus also achieved for the die, which can create a simple modular system of the tool unit. In case of a uniform outer dimension, different profile geometries can thus be formed in the die. A change can be done easily, in which only both the receiving cage parts are to be separated from each other and a corresponding die as well as further distancing elements, if needed, are to be inserted in the receiving area.

Advantageous is also an enhancement according to another embodiment, since like this always a constant installation length of the entire tool unit can be achieved depending upon the profile geometry of the die. This creates a simple possibility of combinations, whereby, by selecting the receiving cage and the tool elements to be arranged in it even in case of most different profile geometries, always a constant complete length of the tool unit can be achieved in discharge direction of the profile. This almost omits additional adjustment and setting work during a tool change.

In case of another design, it is advantageous that in this way both the receiving cage and the tool components to be included in it can be aligned even more exactly to one another.

The enhancement according to another embodiment achieves that such a uniform receiving cage can be created, in which the most different tool components can be placed. This creates the possibility of always putting together a unit corresponding to the profile geometry to be made, which is to be inserted in its totality in the extrusion machine. With this, also the component cost as well as the additional costs can be reduced, since in the individual receiving cages different components showing smaller dimensions are to be used.

However, the task of the invention is accomplished independently by the features of another aspect of the invention. The advantages resulting from the features combinations of this aspect of the invention are that in this way an extrusion machine can be created, in which an adjustment of the gap width between the tool unit and the friction wheel, in particular, its groove, can be done through the lever-like holder of the tool holding device together with the wedge-shaped control element of the setting device even during running operation. Moreover, by providing a locking device, always a secure placing of the tool holding device at the control element and further the support at the base frame can be achieved. Because of this, even in case of abrasion caused by wear and the related increase of the gap width, in particular, between the scraping element and the friction wheel, a re-adjustment of the extrusion machine can be done quickly to some extent even under full load. With that, for instance, also in case of a reduction of gap caused by heat, it can be adjusted to the desired reference value through the corresponding adjustment of the setting device, in particular, of the control element. Through the lever-like formation and support of the tool holding device, the holding forces can be restricted in some limits like this. Since the end area of the tool holding device lying opposite to the swivel axis is arranged at about the same distance from the drive axis of the friction wheel, but on the opposite side, the position fixing of the tool holding device can be done with reasonable holding forces.

Advantageous is also a design according to other embodiments, because with this a completely rigid system can be prevented, but always a secure installation and holding of the tool holding device is achieved through intermediate switching of the control element on the base frame. With that, a corresponding swivel movement of the tool holding device can take place to some extent, in order thus to be able to do the adjustment of the gap width even during operation and under full load.

In doing so, a design according to another embodiment proves to be advantageous, since through this a response can be made to a change of the gap even more quickly. As a result, almost a fully automatic operation can be achieved, through which the quantity of the otherwise accruing waste in the area of the extrusion machine can be reduced.

According to an advantageous enhancement, a uniform receiving chamber is created like this for the tool unit. With that the tool unit can be used on that side of the tool holding device, which is facing the friction wheel. In this way, the support and the application of force can be done directly in the tool holding device. As a result of the production forces acting on the tool unit, therefore, only an adequate positioning of the tool unit is to be ensured in the receiving chamber. In this way, additional fixing means can be avoided, because of which further a tool change can also be done more quickly.

Advantageous is also a design according to another embodiment, because through this, starting from the tool unit, an application of force is done in the tool holding device on a support area aligned at right angles to it. With that, simple and cost-effective positioning surfaces can be formed.

According to another embodiment, in this way a simple modular system is created, in which the most different profile geometries and the tool components necessary for these can easily be used in similar formed receiving cages.

In case of the design as per another embodiment, a drive unit can thus be created, in which case the friction wheel can be clamped between its drive shaft parts in an axial clamping position. Because of the fact that at least one of the drive shaft parts is mounted guided, axially displaceable, relative with respect to the base frame, an easier accessibility can thus be created for removing the friction wheel from the complete drive unit.

In doing so, a design according to another embodiment is also possible, because with this an exactly centered axial run-out of the friction wheel can be achieved together with the drive shaft parts. Moreover, like this and especially together with the form-fitting coupling elements, an even better transmission of force to the friction wheel can be achieved.

The design according to another embodiment enables a form-fitting transfer of the starting torque to the friction wheel, because of which additional fixing means can be avoided. With that, a smooth transfer of the drive torque is achieved in case of engaged coupling elements. If the coupling elements are engaged form-fitting, then a removal of the friction wheel from one of the drive parts can be done easily without additional help tools.

Advantageous is the design according to another embodiment, because like this a uniform drive unit can be created, whereby using at least one follower ring friction wheels having different widths can be fitted. In this way, the axial length of the entire structural unit can easily be adjusted to different requirements. The friction wheel can thus be connected with the drive shaft parts in the corresponding way through the intermediate switching of the follower ring(s). Furthermore, the position of the friction wheel can also be set or adjusted to the tool unit and its position inserted in the tool holding device.

Advantageous is also a design according to another embodiment, because in this way an even more uniform transmission of the drive torque can be done to the friction wheel.

Advantageous is also a design according to another embodiment, because with this a still better mutual alignment and guidance of the drive shaft parts to one another can be achieved. Furthermore, in this way the corresponding clamping forces between both the drive shaft parts can also be transferred or exercised on the friction wheel.

In doing so, a design according to another embodiment proves to be advantageous, because like this a form-fitting connection can be made between the support axis and the first drive shaft part. This type of form-fitting connection is to be realized through a simple rotary movement and further this form-fitting connection is simply to be established for the axial tensile and compressive forces acting on it.

According to an advantageous enhancement, a better axial guiding of the support axis is thus achieved on the base frame. Furthermore, this can also lead to an independent adjustment of the support axis relative to the second drive shaft part and still an adequate support and guiding effect can be achieved for the support axis.

Advantageous is also a design according to another embodiment, because with this a simple distancing of at least one drive shaft part is enabled from the friction wheel arranged in-between. This axial distancing can also cause the form-fitting coupling elements to be not engaged, as a result of which the removal of the friction wheel becomes easier. Moreover, a change of the friction wheel without using tools is thus also possible.

Finally, there is also a design possible, in accordance with another embodiment, because with this the removal of the friction wheel can be simplified between both the drive shaft parts. This improves the accessibility even more and simplifies the working of the assembly staff. Moreover, it is also made possible to remove the friction wheel from the drive unit by using external lifting means.

However, independent of this, the task of the invention is also solved by a method for changing a friction wheel of an extrusion machine, connected with a drive unit, which can be rotated on a drive axis, according to the features specified in another aspect of the invention. The advantages resulting from the feature combination of this aspect are that, like this, a simple option can be created for changing the friction wheel from the entire drive unit, in which case there is adequate space available for carrying out this assembly and changing activity. Because of the fact that the drive unit is divided in drive shaft parts arranged on both side of the friction wheel, these can be distanced from each other for the assembly activity. The joint support axis arranged within the drive shaft parts helps during operation to create a drive unit more resistant to bending. Furthermore, the support axis also helps in building up adequate clamping forces between both the drive shaft parts, in order thus to be able to fix and hold the friction wheel in an axial clamping position in-between. Because of the fact that the form-fitting connection between the support axis and the first drive shaft part can be loosened, in this way the position of the support axis pushing the friction wheel can also be changed, which results in an unhindered removal of the friction wheel from the drive unit.

Moreover, a method according to the features given in another embodiment is advantageous, because with this an even easier accessibility and hence an increase in the space offered for removing the friction wheel from the drive unit can be provided.

Advantageous is also a method variant according to another embodiment, because in this way an even bigger space can be offered for accessibility to the friction wheel.

BRIEF DESCRIPTION OF THE DRAWINGS

The invention has been explained with the help of the FIGS. given below for a better understanding.

The FIGS. show in strongly simplified, schematic representation.

DETAILED DESCRIPTION OF THE PREFERRED EMBODIMENTS

At the outset it is mentioned here that same parts have been given the same reference signs or same component names in the different embodiments described, and the disclosures contained in the entire description can be applied analogously to same parts with same reference signs or same component names. Even the position specifications selected in the description, such as above, below, on the side, etc. refer to the described and shown FIG., and these position specifications can be applied analogously to the new position in case of a position change.

Figure 1:
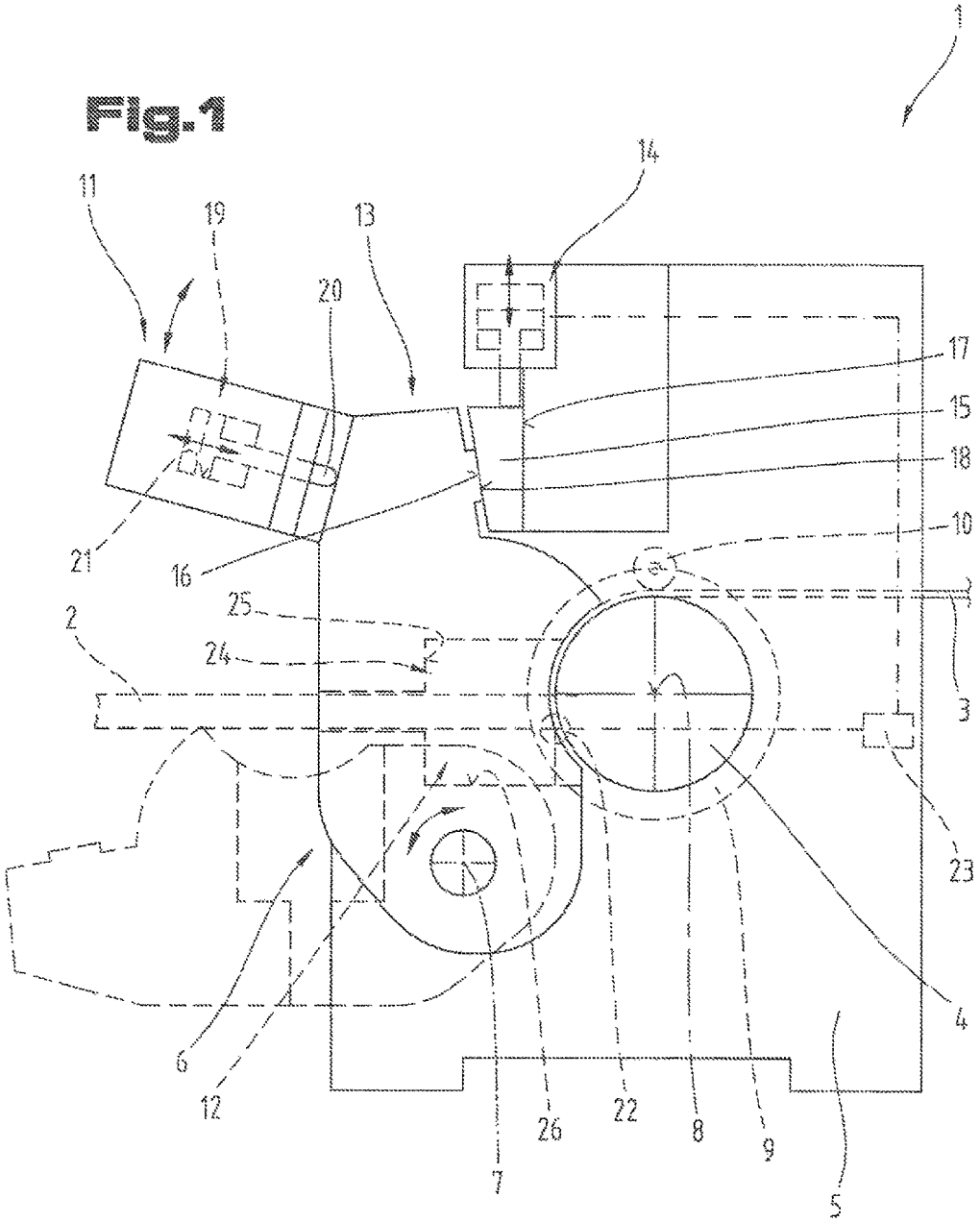
FIG. 1 an extrusion machine in lateral view as well as stylized representation.

In FIG. 1, an extrusion machine 1 is shown in strongly stylized representation, which serves for manufacturing of profiles 2 starting from a moldable extrusion material 3.

The extrusion machine 1 shown here represents a special form of extrusion machines 1, which enable a continuous manufacture. In doing so, for instance, a constant wire with a diameter between 5 and 30 mm is fed as extrusion material 3 to the extrusion machine 1 and is heated there to 500° C. and above via a driven friction wheel 4 depending upon the material to be molded. The dough-like material is then pressed through a die arranged immediately after the friction wheel 4, whereby in this section the molding process takes place. This continuous method is preferably used for profiles 2 having low and medium-sized dimensions. While doing so, different materials, such as aluminum, copper, non-ferrous metals or their alloys can be molded. The molding process that can be conducted continuously in this extrusion machine 1 over a longer period of time and the fact that for this a single, relatively small and simply built extrusion machine 1 is necessary, enable a cost reduction as compared to the conventional extrusion machines.

The extrusion machine 1 can basically include a base frame 5 as well as a tool holding device 6, which is mounted as swiveling or rotating on a swivel axis 7 held on the base frame 5. The swivel movement is shown in a simplified way with a double arrow in the area of the swivel axis 7. In this way, the tool holding device 6 can be swiveled between a working position and a release position, as needed. The display of swivel mechanisms or adjusting mechanisms has not been given for the sake of clarity, whereby it is mentioned that all devices or elements as per the state of the art technology can be used here. Further, seen in the direction of passage of the profile 2 to be fabricated, the tool holding device 6 is arranged after the friction wheel 4. Thus, the work position is shown here in full lines and the release position simplified in dashed lines.

The friction wheel 4, as is known, can be rotated on a drive axis 8 and is further present in a drive connection with a drive unit 9 shown only schematically. Moreover, at least one provided friction wheel 4 also has at least one peripheral groove. Further, at least one pinch roller 10 can be assigned to the friction wheel(s) 4, with which the extrusion material 3 entering in the extrusion machine 1 and to be molded is pressed in radial direction at the friction wheel(s) 4.

The extrusion machine 1 further includes also a locking device 11, which is mounted, for instance, as swiveling at the base frame 5. The locking device 11 helps in holding the tool holding device 6 as positioned during its work position and operation relative to the base frame 5, especially the friction wheel 4. A double arrow entered in the area of the locking device 11 schematically represents the displacement possibilities of the locking device 11. The locking position for the tool holding device 6 is shown in FIG. 1. The representation of its support on the base frame 5 as well as the adjustment mechanisms necessary for this have also not been shown, in order to maintain clarity. Thus, for instance, the locking device 11 can be formed in a U-shaped holding frame, in which both the holding arms 5 are mounted to the side of the base frame as swiveling. The base arm connecting both the holding arms externally, holds, for instance, the tool holding unit 6 in the locking position and prevents a swiveling away of the tool holding device 6 from its working position. Further, a tool unit 12, shown here only schematically, is supported mostly at the tool holding device 6, whereby the formation of the tool unit 12 is described in detail in the following FIGS.

As is known, in the extrusion machine 1 under operation and hence with the tool holding device 6 present in working position, a gap is formed between the tool unit 12 and the friction wheel 4, in order to avoid collisions and the mechanical damages related with it.

Since the gap width of the gap between the friction wheel 4 and the tool unit 12 depends on the one hand from the temperature of the parts as well as on the other on wear signs of the tool unit 12, an exact and mainly adjustable setting of the gap width of the gap is an independent aspect in itself for the present invention. Thus, the adherence to as well as setting of the gap width can represent an independent task for the invention and correspondingly also represent an independent solution regardless of the further parts described here as well as process steps.

Thus, in case of the design example shown here, in addition to the locking device 11 at the base frame 5, a separate setting device 14 is arranged in an end area 13 of the tool holding device 6, distanced from the swivel axis 7 as well as lying opposite with respect to the drive axis 8 of the friction wheel 4. The setting device 14 shows a setting element 15 built as adjustable with respect to the base frame 5. The setting element 15, in turn, shows an adjusting area 16 facing the end area 13 of the tool holding device 6 as well as a guide area 17 facing away from the tool holding device 6.

As can be seen from the schematic representation of the setting element 15, the setting area 16 and the guide area 17 are aligned in shape of a wedge to one another. The guide area 17 is supported on a section of the base frame 5, not described here in detail, built as sliding surface. The setting element 15 is further connected with a setting mechanism not described in detail and is adjustable in the direction of a schematically entered double arrow relative to the base frame 5. Thus, the guide surface 17 runs vertically, whereby the setting area 16 aligned sloping to it runs from top left to bottom right, as can be seen from the lateral view of the extrusion machine 1.

The tool holding device 6 shows a support area 18 at its end area 13 distanced from the swivel axis 7 as well as at a first side facing the friction wheel 4. In case of the tool holding device 6 in working position, the support area 18 formed or arranged at the tool holding device 6 is supported at the setting area 16 of the setting element 15.

The locking device 11 described earlier further shows at least one pressure unit 19 with at least one pressure element 20. In doing so, the pressure element 20 is also arranged in an end area 13 distanced from the swivel axis 7 in case of the tool holding device 6 present in working position, but is present in contact with the tool holding device 6 at a second side facing away from the friction wheel 4. Furthermore, the support area 18 of the tool holding device 6 is pressed against the setting area 16 of the setting element 15 by means of the pressure unit 19. Because of the fact that the setting element 15 is supported with its guide surface 17 at the base frame 5, in case of a relative shifting of the setting element 15 by means of the setting device 14, the tool holding device 6 can be moved on its swivel axis 7 owing to the setting area 16 and guide area 17 arranged wedge-shaped, in particular, acute-angled to one another. Since the tool holding device 6 in the broadest sense corresponds to a lever or a lever arrangement, with this also the gap forming between the tool unit 12 and the friction wheel 4 as a result of the adjustment of the setting element can be changed in its gap width.

Further, in the area of the locking device 11, it is shown in a simplified way that the pressure element 20 of the pressure unit 19 is included at least area-wise in a pressure chamber 21 and is thereby exposed to the pressure medium present in the pressure chamber 21 shown simply with dashes. In doing so, the pressure medium can be a liquid or a gas, whereby an almost incompressible fluid, such as hydraulic oil, proves to be favorable, in particular, in case of high pressures. The pressure element 20 can, for instance, be formed as a double-acting piston of a cylinder-piston arrangement, with which at the corresponding exposure the pressure element 20 is pressed against the second side of the tool holding device 6. Through this pressing of the end area 13 with its support area 18 against the setting element 15, owing to the mounting of the tool holding device 6 on the swivel axis 7, an exactly defined position of the tool unit 12 inserted or arranged in the tool holding device 6 can be achieved with respect to the friction wheel 4. Through the corresponding setting movement of the setting device 14 with its wedge-shaped areas aligned to each other, namely the setting area 16 and the guide area 17, a corresponding shifting of the tool holding device 6 on the swivel axis 7 is achieved.

If an adjustment of the setting element 15 of the setting device 14 is done, not only the relative position of the tool holding device 6 with respect to the base frame 5, in particular, of the friction wheel 4 gets shifted, but there is also a volume change of the pressure medium present in the pressure chamber, as a result of which the pressure element 20 gets displaced in its relative position with respect to the pressure unit 19. In order to enable this compensation in the pressure system, pressure-relief valves can be used, in order to avoid a rigid system and to enable the adjustment of the pressure element 20.

Depending upon, whether a relative displacement of the pressure element 20 takes place in the direction of the friction wheel 4 or in the direction opposite to it, there is an automatic compensation of the pressure medium in the pressure chamber 21. In this way, the tool holding device 6 can be swiveled in its relative position in the direction of the friction wheel 4 as well as also in a direction opposite to it. The constant holding and locking of the tool holding device 6 in its end area 13 remains maintained unchanged through the locking device 11 and there is always a proper placing of the support area 18 of the tool holding device 6 at the setting area 16 of the setting element 15. The setting element 15 is, as already described earlier, supported through its guide area 17 on the base frame 5 preferably sliding as well as guided, if applicable.

Further, in the gap formed in the area between the tool unit 12 and the friction wheel 4, a measuring device 22 can be arranged. This is shown schematically with a circle. The measuring device 22 determines the actual gap width and can, in turn be connected with an evaluation and/or control unit 23. For the sake of simplicity, this is shown with a rectangle. In this evaluation and/or control unit 23, the determined value for the gap width can be compared with an entered reference value and subsequently a corresponding control or setting signal can be sent to the setting device 14. For this, the evaluation and/or control unit 23 is connected with the setting device 14. Depending upon the result of the evaluation process, the setting device 14 can then displace the setting element 15 to the extent that the pre-defined gap width is reached. This setting movement as well as re-adjustment can be done during operation under full load. The advantage of this is that the machine need not be stopped, but instead a change of the gap width can be done directly and immediately. This can be done with the setting element 15 of the setting device 14, formed as a setting wedge, as described earlier.

Furthermore, it is also shown here that a receiving chamber 24 is built or arranged in the tool holding device 6. The outlines of the receiving chamber 24 are only shown simplified, whereby in this chamber the tool unit 12 is included. For supporting the tool unit 12, the receiving chamber 24 shows at least two angular, in particular right-angled, first and second positioning surfaces 25, 26 aligned to one another, at which the tool unit 12 is supported. In case of the tool holding device 6 present in the working position, in the design example shown here, the first positioning surface 25 is arranged on the side of the tool unit 12 facing away from the friction wheel 4. It is further shown that the receiving chamber 24 is formed open in the direction of the friction wheel 4. Thus, in the working position of the tool holding device 6 the first positioning surface 25 is aligned in vertical direction with respect to the direction of passage of the profile 2.

Figure 2:
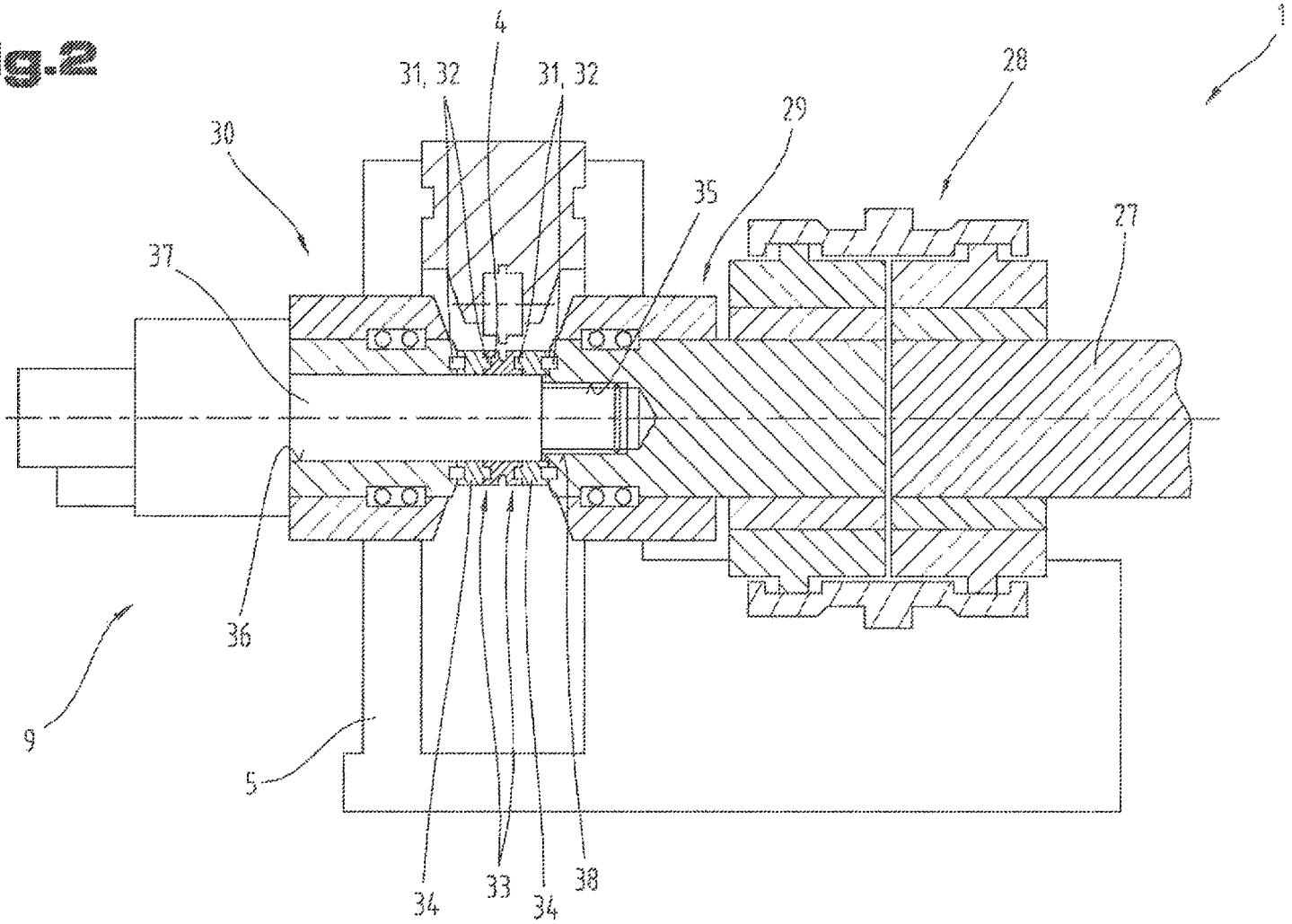
FIG. 2 the extrusion machine in the area of its drive unit in a position clamping the friction wheel; cut in section.
Figure 3:
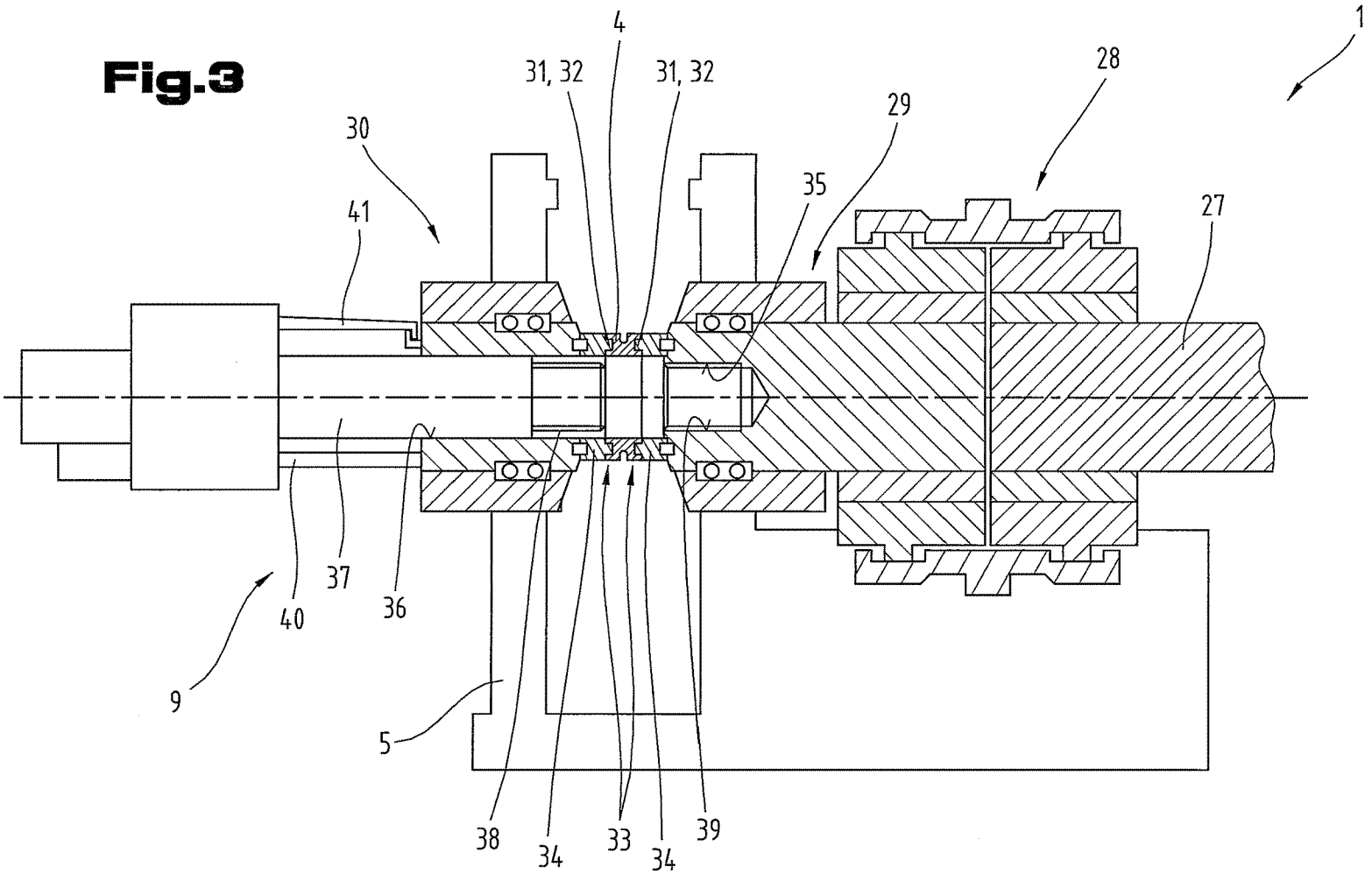
FIG. 3 the drive unit according to FIG. 2, in an intermediate position during the opening movement for releasing the friction wheel, cut in section.
Figure 4:
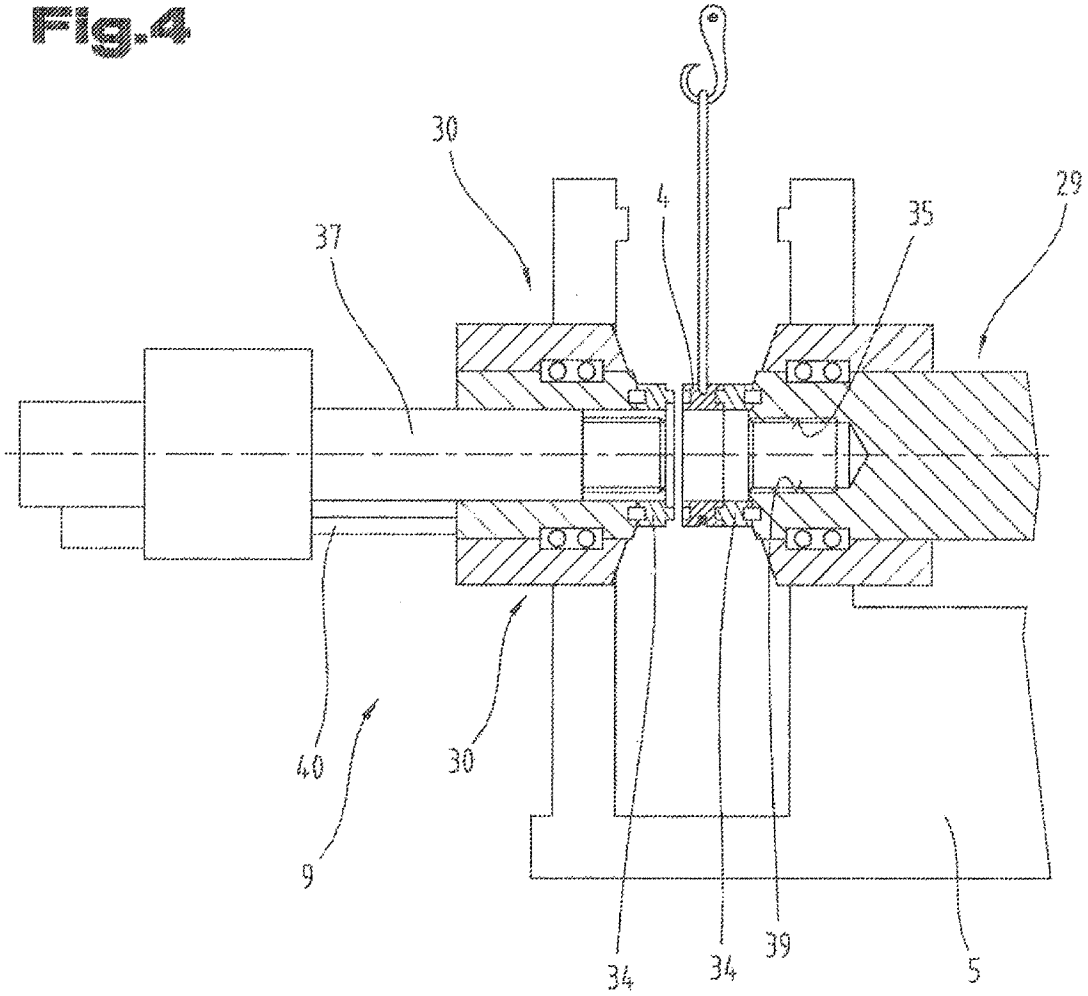
FIG. 4 the drive unit according to FIG. 2 and 3, in the release position for the friction wheel, cut in section.

FIG. 2 to 4 show a further and possible independent design example of the drive unit 9 of the extrusion machine 1, whereby again same reference symbols/component names have been used for the same parts, as done in the previous FIG. 1. In order to avoid unnecessary repetitions, a reference is made to the detailed description in the previous FIG. 1. In addition, it is also explicitly pointed out that the drive unit 9 described below for the drive of the friction wheel 4 together with the extrusion machine 1 can also represent an independent solution or design of the present invention regardless of the earlier described gap adjustment in the area of the tool holding device 6. However, a combination with the features of the components regarding the gap adjustment is also possible.

The drive unit 9 shown here as simplified can itself be built from a number of different assemblies or structural elements. The driving torque for the friction wheel 4 can occur, for instance, through a drive motor with a gearbox connected downstream as well as a drive shaft 27. Using a coupling 28 the driving torque is passed on to first and second drive shaft units 29, 30 arranged on both sides of the friction wheel 4 and mounted as rotating on the frame parts of the base frame 5. In doing so, at least one of the drive shaft parts 29, 30 is formed as adjustable in axial direction with respect to the base frame 5 for the friction wheel 4 from a contact position lying at friction wheel 4 in an alternating position distanced from the friction wheel 4. In the design example given here, the assembly of the drive shaft part 29 arranged on the right side and the coupling 28 connected with it are mounted locally at the base frame 5, in particular, at its right frame part. It is further also shown here that the friction wheel 4 lies adjacent on the drive shaft parts 29, 30 arranged on both sides and is additionally held clamped in axial direction between both these drive shaft parts 29, 30. A centering with respect to the common drive axis 8 can be provided on both sides between the friction wheel 4 and the drive shaft parts 29, 30.

In order not just to achieve a clamping and the related holding of the friction wheel 4 at one of the drive shaft parts 29, 30 based exclusively on friction, the friction wheel 4 can be coupled as torque-proof with at least one of the drive shaft parts 29, 30 in its adjacent lying contact position via cooperating first and second coupling elements 31, 32 of a coupling device 33. Preferably, a coupling device 33 is arranged or formed on both side of the friction wheel 4.

In doing so, it can be advantageous, when a follower ring 34 is provided on at least one of the drive shaft parts 29, 30, preferably at both the drive shaft parts 29, 30 respectively at the side facing the friction wheel 4. In doing so, the first coupling elements 31 can be arranged or formed on at least one of the ring front face of at least one of the follower rings 34 facing the friction wheel 4. In order to achieve a more uniform transmission or application of the driving torque in the friction wheel 4, the friction wheel 4 can have several second coupling elements 32 arranged offset to one another in the peripheral direction on both the front faces distanced from each other in the direction of the drive axis 8.

Thus, for instance, the first coupling elements 31 can be formed on the drive shaft parts 29, 30 or the follower ring 34 through protrusions and/or recesses. The second coupling elements 32 arranged or formed on the friction wheel 4 are to be formed in a mirror-inverted image of this through recesses and/or protrusions.

With this, in addition to the axial clamping, a form-fitting coupling connection is achieved between the friction wheel 4 and at least one of the drive shaft parts 29, 30, but preferably between both.

It can further be seen here that both the drive shaft parts 29, 30 show a cylinder-shaped first and second receiving opening 35, 36 in their center. These are preferably aligned with each other, in order thus to be able to receive a common support axis 37. In doing so, an additional support effect of both the drive shaft parts 29, 30 can be achieved in their center too through a corresponding selection of the fit. This also increases the inherent stiffness of the complete drive unit 9.

Further, the support axis 37 can have an outer thread 38 at an axis end area facing the first drive shaft part 29. In order to be able to couple the support axis 37 in a form-fitting way with its axis end area with the first drive shaft part 29, the first receiving opening 35 of the first drive shaft part 29 can be provided with an inner thread 39. In this way, the support axis 37 can be connected tightly in axial direction with the first drive shaft part 29. In doing so, it is noted that in place of the thread arrangement, including the outer thread 38 as well as the inner thread 39, even other form-fitting tight means of connection can be provided, in order to couple or connect the support axis 37 tightly with the first drive shaft part 29. Consideration must be given to an easy release of the coupling elements present in coupling grip in this area, in order to be able to change the friction wheel quickly and without long shutdown times.

After disengaging the axis end area of the support axis 37 with the first drive shaft part 29, the support axis 37 can be mounted as sliding, guided in the second receiving opening 36 built in the second drive shaft part 30.

If the support axis 37 is present in its tightly connected position with the first drive shaft part 29, the second drive shaft part 30 can be adjusted in the direction of the first drive shaft part 29 by means of corresponding formed tensile and/or pressure elements so that the friction wheel 4 is held clamped in axial direction between both the drive shaft parts 29, 30. The form-fitting force transmission starting from at least one of the drive shaft parts 29, 30 to the friction wheel 4 can be done through the coupling device 33 described earlier and its first and second coupling elements 31, 32.

As can now be seen from FIG. 3, the support axis 37 can be displaced from its working position pushing the friction wheel 4 and connected with the inner thread 39 of the first drive shaft part 29 in axial direction to an extent that an axis end of the support axis 37 facing the first drive part shaft 29 is arranged outside of the friction wheel 4. However, if instead of the screw connection with inner thread 39 and outer thread 38 described here, a different coupling device with engaging means of coupling is provided, then for instance the rotating movement described earlier can be omitted If now the support axis 37 is displaced to the extent that it no longer extends into the friction wheel 4, the second drive shaft part 30 is to be adjusted together with the support axis 37 present in it in axial direction from the contact position lying at the friction wheel 4 in the alternate position distanced from the friction wheel 4.

The first described adjustment movement of the support axis 37 can be carried out, for instance, in a way that after loosening the form-fitting connection from the axis end area facing the first drive shaft part 29, a setting device 40 e.g. with a cylinder-piston arrangement is arranged at this opposite lying end area of the support axis 37. Because of the fact that the support axis 37 is mounted sliding in the second drive shaft part 30, using the setting device 40 an axial adjustment of the support axis 37 can be done in the position shown in FIG. 3. For this, the setting device 40 is connected with the end of the support axis 37 facing away from the first drive shaft part 29. Further, the setting device 40 is also supported, if applicable, on the base frame 5 by intermediately connecting the components not shown here in detail. With corresponding activation of the setting device 40, the axial adjustment of the support axis 37 can be done.

If the intermediate position shown in FIG. 3 is reached, a connection lever 41 or a setting lever is coupled or engaged with the second drive shaft part 30 mounted in the base frame 5 in a position that can be displaced axially. In this way, in case of a further adjustment of the setting device 40 a common adjustment of the support axis 37 as well as of the second drive shaft part 30 can be done relative with respect to the base frame 5 on the here left side of the base frame 5. This position is shown in FIG. 4, whereby it can now be seen that the adjacent contact position of the here second drive shaft part 30 is reversed by the friction wheel 4. With the corresponding selection of the length of the axial displacement then the friction wheel 4 can take place from the drive shaft part 29 arranged here on the right side.

The earlier described follower rings 34 can help, for instance, in building always a constant axial distance in case of change of the axial length of the friction wheel 4 through the corresponding exchange or adjustment of the follower rings 34.

The process or the method of changing at least one of the friction wheels 4 of the extrusion machine 1, connected with the drive unit 9 and rotating on the drive axis 8, can in doing so include at least the following steps and can also represent a solution as per the invention all by itself.

At first, the form-fitting connection between the axis end area of the support axis 37 and the first drive shaft part 29 of the drive unit 9 mounted as rotating on the base frame 5 is loosened. If this form-fitting axial connection is loosened, the support axis 37 in the second drive shaft part mounted as rotating on the base frame 5 is adjusted in the direction facing away from the first drive shaft part 29. In doing so, the support axis 37 is adjusted to an intermediate position, in which the friction wheel 4 is no longer pushed by the support axis 37. Consequently, at least the axis end area of the support axis 37 is present outside of the cross-section of the friction wheel 4. Subsequent to this, there is a joint adjustment of the second drive shaft part 30 and the support axis 37 mounted as guided in it in the direction facing away from the first drive shaft part 29. This results in loosening of at least one of the drive shaft parts 29 and/or 30 lying at the friction wheel 4. In the given design example, as can also be seen from FIG. 4, the friction wheel 4 remains at the first drive shaft part 29 and then in case of a corresponding release can be loosened, in particular, uncoupled from this and removed from the extrusion machine 1.

It is further advantageous, before starting the change of friction wheel, to adjust the pinch roller 10 arranged above the friction wheel 4 from its pinch position acting together with the friction wheel 4 in a release position distanced from the friction wheel 4 for the extrusion material 3 to be molded. This is supposed to simplify the access to the friction wheel 4 and its subsequent removal as well as insertion in the extrusion machine 1. Preferably, the pinch roller 10 is adjusted first upward in vertical direction in the direction facing away from the friction wheel 4. Subsequent to this, the pinch roller 10 can still be adjusted in the direction of passage of the extrusion material 3 or the profile 2 to be molded in a position further distanced from the friction wheel 4. Furthermore, before starting the change of the friction wheel, the tool holding device 6 possibly with the tool unit 12 inserted or supported in it is to be swiveled from its working position immediately adjacent to the friction wheel 4 to a release position distanced from it. This enables an even more easy access to the friction wheel 4 and simplifies the activities of removal as well as new installation.

Figure 5:
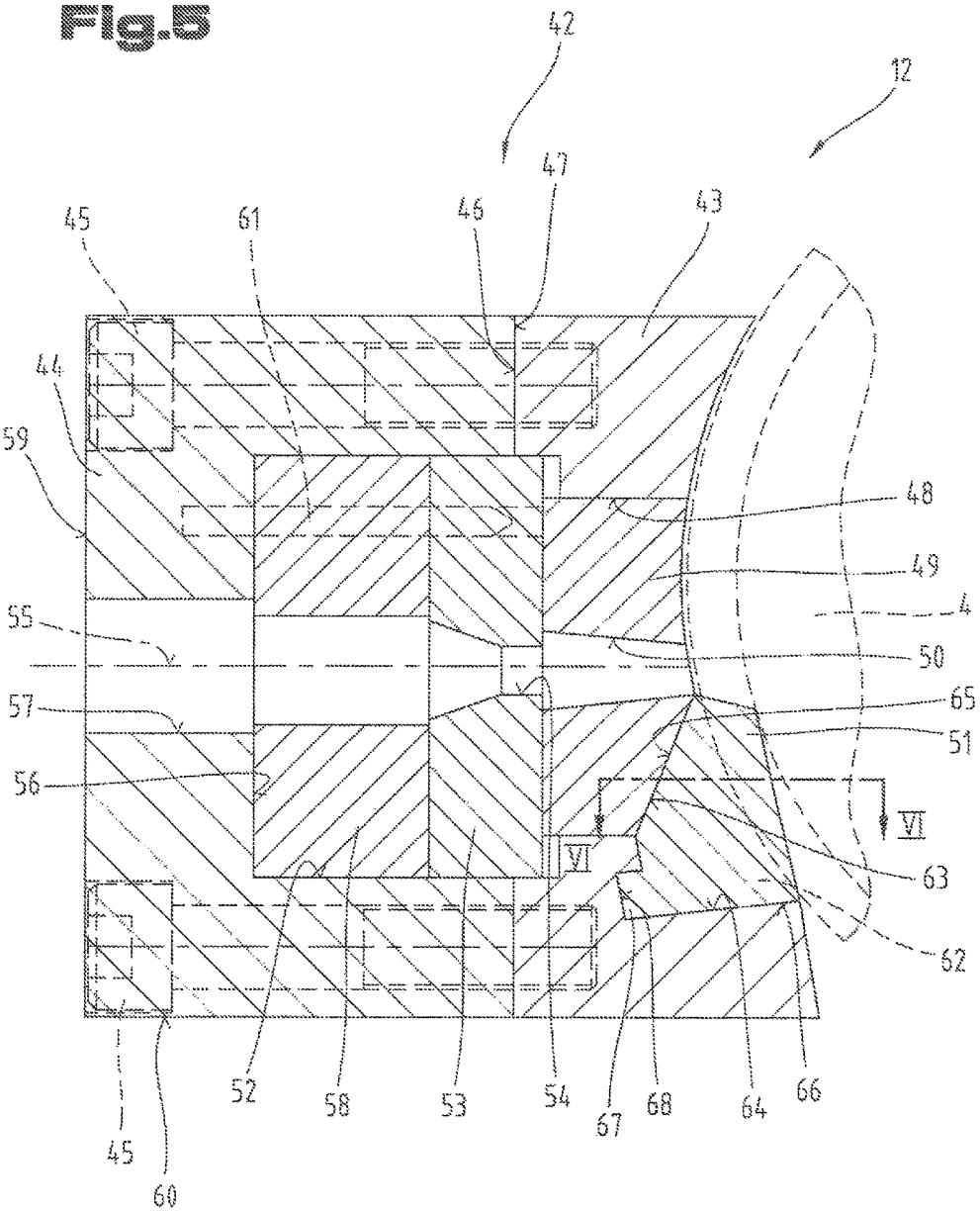
FIG. 5 a first tool unit for an extrusion machine, cut in lateral view as well as stylized representation.
Figure 6:
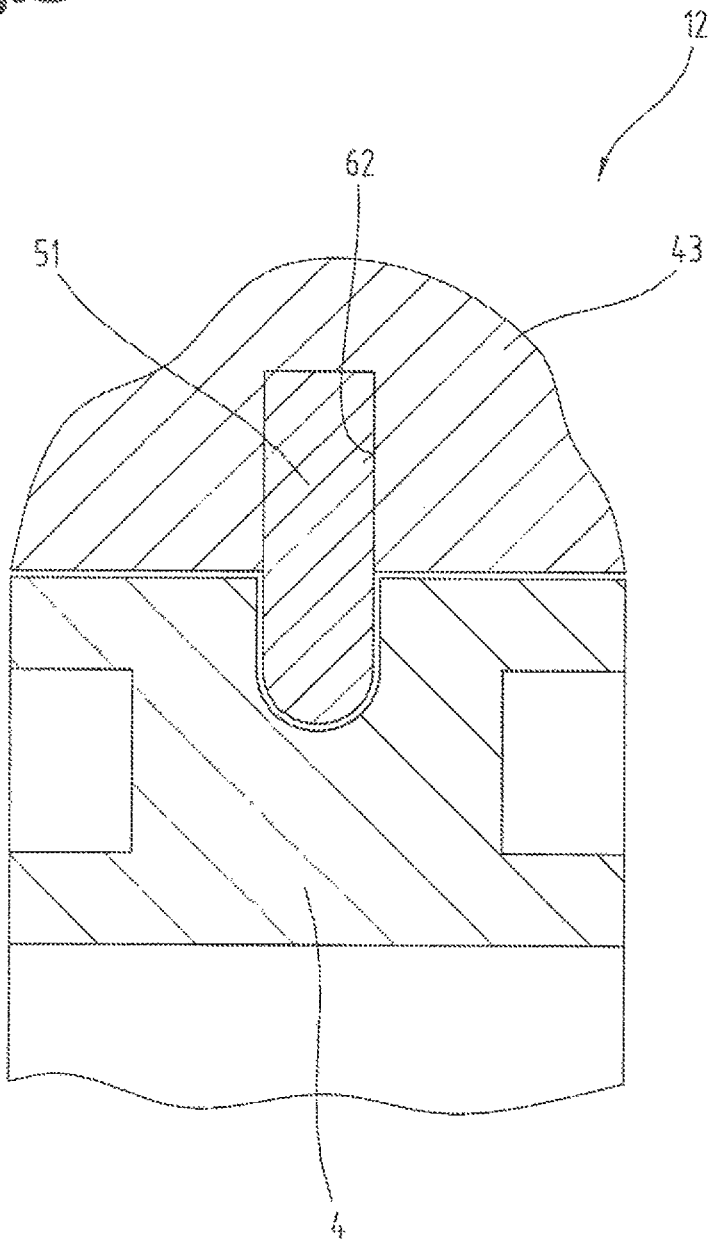
FIG. 6 the scraping element of the tool unit, cut in top view as per lines VI-VI in FIG. 5.

FIG. 5 and 6 show a further and possibly independent design example of the tool unit 12, whereby again same reference symbols/component names have been used for the same parts, as done in the previous FIG. 1 to 4. In order to avoid unnecessary repetitions, a reference is made to the detailed description in the previous FIG. 1 to 4. The tool unit 12 described here in detail is formed for interaction with the already earlier described extrusion machine 1, but can also be used with a differently shaped tool holding device 6. Preferably, however, the tool unit 12 helps in the interaction with the tool holding device 6 and the adjustment or setting of the gap widths related to it.

The tool unit 12 shown here is built for receiving in the tool holding device 6 described earlier and includes, in turn, a receiving cage 42, which shows a first receiving cage part 43 arranged on the inlet side and a second receiving cage part 44 arranged on the outlet side. Both the receiving cage parts 43, 44 can further be connected adjacent next to each other and with each other via means of connection 45, such as screws, etc., at the front surfaces 46, 47 facing each other. In the first receiving cage part 43, a receiving channel 48 pushing in the passage direction of the extrusion material 3 is provided, in which at least one tool element 49 is inserted arranged on the inlet side. In the at least one tool element 49 arranged on the inlet side, there is an expanding channel 50 formed for receiving the extrusion material 3 stripped away by the friction wheel 4 and already softened by it.

For deflecting or stripping the extrusion material 3 softened by the friction wheel 4, the tool unit 12 also includes, as is known, a scraping element 51 arranged on the inlet side.

The second receiving cage part 44 arranged after the first receiving cage part 43 shows a receiving chamber 52 facing the first receiving cage part 43 and opening towards it. In the receiving chamber 52 at least one die 53 is inserted. The die 53 is arranged after the tool element 49 arranged on the inlet side in the direction of passage of the extrusion material 3. Further, the die 53 is equipped with a molding channel 54, which helps in molding the profile 2 to be manufactured. The expanding channel 50 as well as the molding channel 54 define a profile axis 55 for the profile 2 to be manufactured. For this, the profile axis is preferably aligned in a straight line as well as in a horizontal plane.

The receiving chamber 52 is restricted on the outlet side at least area-wise by a support surface 56. Subsequent to the receiving chamber 52 there is a passage opening 57 in the second receiving cage part 44 for the profile 2 coming out of the tool unit 12. Further, the die 53 is supported, if needed, by intermediately connecting at least one distancing element 58 at the support surface 56 restricting the receiving chamber 52 on the outlet side.

In the assembled or composite state of both the receiving cage parts 43, 44 building the receiving cage 42, a coherent structural unit is formed from this, in which the die 53, at least one distancing element 58, the tool element 49 arranged on the inlet side as well as the scraping element 51 are inserted or held in it. Thus, the receiving cage 42, in particular, its second receiving cage part 44 shows at its end at the outlet side a first contact surface 59, which is aligned in a plane running perpendicular to the profile axis 55. Further, the receiving chamber 52 shows at its lower side in the working position a further contact surface 60 running angular with respect to the first contact surface 59, in particular, running perpendicular to it. In doing so, the second contact surface 60 stretches preferably over the first receiving cage part 43 as well as the second receiving cage part 44. This makes it possible first to arrange the components of the tool unit 12 to be received or placed in both the receiving cage parts 43, 44, subsequently to set up both the receiving cage parts 43, 44 on a plane mounting surface and push them against each other for so long till both the front faces 46, 47 come to lie adjacent to each other. Subsequent to this, a connection can be made between both the receiving cage parts 43, 44 by using means of connection.

In the design example shown here, the tool element 49 arranged on the inlet side is supported directly at the die 53 and the distancing element 58 provided here at the support surface 56 of the second receiving cage part 44. This makes it possible to always achieve a same longitudinal stretch of the tool unit 12 starting from the first contact surface 59 in the direction of the profile axis 55 till the start of the expanding channel 50 at the inlet side. Thus, the tool unit 12 can be inserted in the earlier described receiving cage 24 of the tool holding unit 6 and can be brought in contact there at both the positioning surfaces 25, 26. Since here always the same longitudinal stretch of the tool unit 12, as described earlier, is executed exactly and can be held, further the setting of the gap width can be predetermined exactly through the setting device 14 via the relative position of the setting element 15.

The die 53 as well as the distancing element 58 can show a cylindrical outer shape at its outer periphery with respect to the profile axis 55. The receiving chamber 52 formed in the second receiving cage part 44 is then to be formed with a corresponding mirror-inverted shape of the space. For achieving a unique alignment of the molding channel 54 arranged in the die 53 at least the die 53, but preferably also the distancing element 58 can be inserted guided in the receiving chamber 52 formed in the second receiving cage part 44 in axial direction with respect to the profile axis 55. This can be done, for instance, by means of a centering pin 61 shown as simplified, which is indicated by dotted lines. This is arranged in the outlet side end area of the second receiving cage part 44 and stretches in the direction of the first receiving cage part 43.

In order also to ensure a unique alignment of the tool element 49 arranged on the inlet side with respect to the receiving channel 48 formed in the first receiving cage part 43, the tool element 49 as well as the receiving channel 48 can show, seen in the peripheral direction along the profile axis 55, a form-fitting interacting peripheral geometry. This could be done, for instance, through a cylindrical shape with lateral flat portions or a polygonal cross-sectional shape.

As can now be seen better from an overview of FIG. 5 and 6, a common receiving groove 62 is arranged or formed in the tool element 49 arranged on the inlet side as well as in the first receiving part cage 43. In doing so, the receiving groove 62 is restricted by at least one groove base surface 63, 64. The scraping element 51 is loosely inserted in the receiving groove 62 and supported at one groove base surface 63, 64 load-supporting.

As is known, the scraping element 51 extends into the groove formed in the friction wheel 4 and deflects the softened extrusion material 3 from the groove of the friction wheel 4 in the expanding channel 50 of the tool element 49 at the inlet side. While doing this, the scraping element 51 is subject to a high wear and needs to be exchanged or replaced very often. Through the corresponding selection and alignment of the groove base surfaces 63, 64, it is possible to attach the scraping element 51 loosely and hence without any additional holder or clamping effect at the tool unit 12. Furthermore, an inner cooling of the scraping element 51 can also be provided, in order thus to minimize the temperature load.

Thus, in the design example shown here, in the tool element 49 arranged on the inlet side the first groove base surface 63, and in the first receiving part cage 43 the second groove base surface 64 is arranged or formed. In doing so, both the groove base surfaces 63, 64 are aligned or formed running up to each other in direction of the second receiving cage part 44 arranged on the outlet side. At the scraping element 51, first and second contact surfaces 65, 66 aligned in mirror-inverted way are to be formed. Owing to these groove base surfaces 63, 64 aligned running up to each other, the scraping element 51 is pressed at them, as a result of which a kind of self-centering and holding can be achieved of the otherwise loosely inserted scraping element 51 in the receiving groove 62. The lateral support is provided at the side surfaces of the receiving groove 62.

Further, the scraping element 51 can have a holding unit 67 at its end section facing the second receiving cage part 44 and formed between both the contact surfaces 65, 66. The holding unit 67 can be formed as a protruding nose and can engage in a mirror-inverted holding unit opening 68 formed for this.

Figure 7:
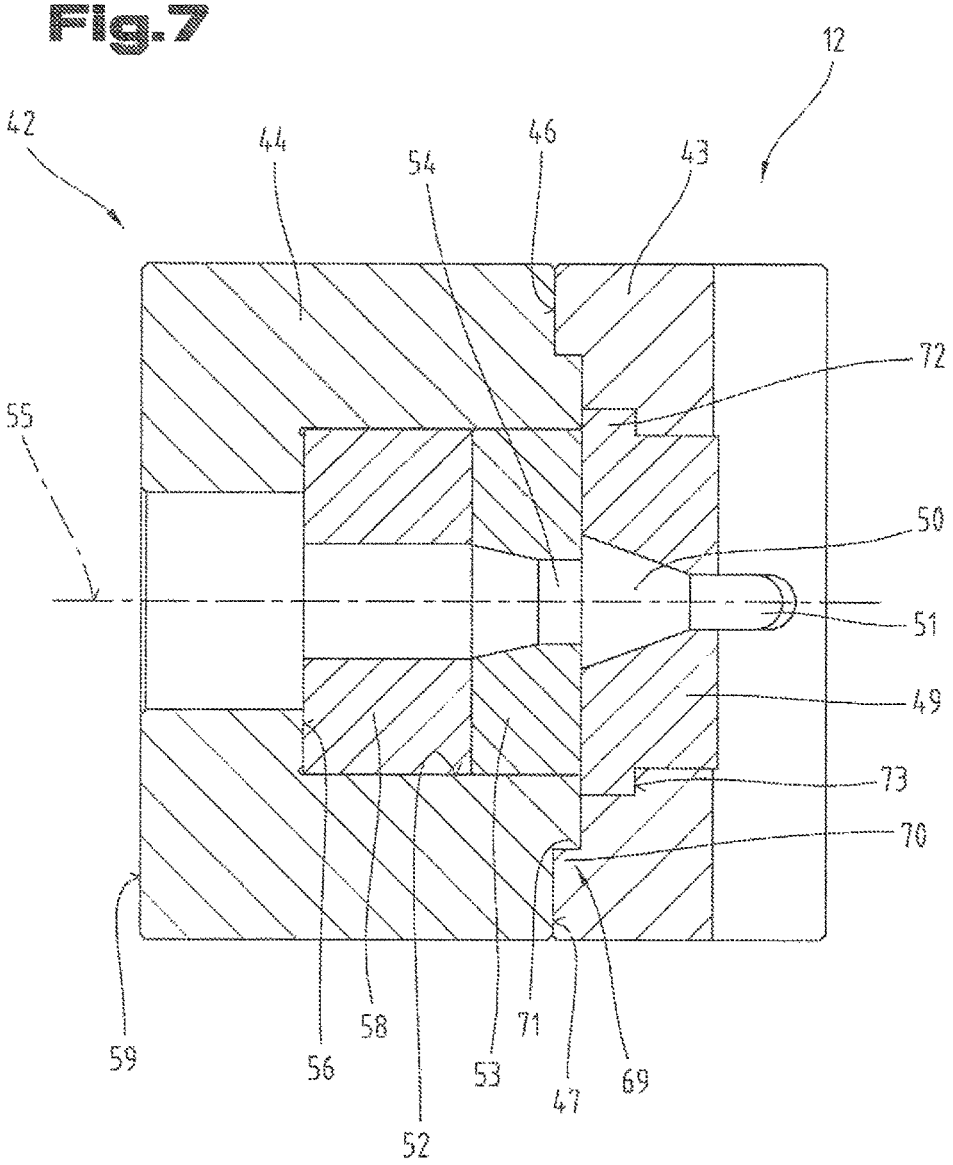
FIG. 7 a further tool unit, cut in top view.

FIG. 7 shows a further and possible independent design example of the tool unit 12, whereby again same reference symbols/component names have been used for the same parts, as done in the previous FIG. 1 to 6. In order to avoid unnecessary repetitions, a reference is made to the detailed description in the previous FIG. 1 to 6.

In the horizontal section shown here schematically, the receiving cage 42 is shown again with both its receiving cage parts 43, 44. In the receiving chamber 52 built in the second receiving cage part 44, the distancing element 58 as well as the die 53 can be inserted. A corresponding alignment and adjustment of both these parts can be done with the help of the centering pin 61, as has already been described earlier.

Contrary to the design form described above, the tool element 49 at the inlet side with its expanding channel 50 arranged in it is supported with its end surface at the outlet side at the second receiving cage part 44. It is further shown here that at the front surfaces 46, 47 facing each other of both the receiving cage parts 43, 44 a centering arrangement 69 is arranged or provided with interacting centering elements 70, 71. This can help achieve a more exact mutual alignment of both the receiving cage parts 43, 44 to be connected with each other.

Furthermore, it is also shown here that the tool element 49 at the inlet side shows at its outer periphery a protrusion 72 protruding over the outer contour. In this case, the protrusion can be arranged or provided as a peripheral flange-type extension or also area-wise over the periphery.

In case of a corresponding rework of the inlet-side contour—which is directly facing the friction wheel 4—of the tool element 49, the concave running front surface facing the friction wheel 4 is to be reworked. This shortens the earlier described total length of the tool unit 12. In order to get a corresponding length adjustment, the protrusion front face 73 facing the friction wheel 4 in this example is also to be reworked by a corresponding amount. Through this processing sequence, the concave tool element surface facing the friction wheel 4 is shifted by the specified reference measure of the longitudinal stretch with the start of the expanding channel 50. In order to be able to balance the gap arising otherwise between the tool element 49 and the die 53, a further, additional distancing element 58 with a corresponding thickness is to be inserted in the receiving chamber 52. This, in turn, ensures a continuous fixed contact starting from the tool element 49, the die 53 as well as the distancing element(s) 58 at the support surface 56 of the receiving chamber 52.

The design examples show possible design variants of the extrusion machine 1, its tool holding device 6 with the tool unit 12 inserted and supported in it as well as the drive unit 9 for the friction wheel 4, and it is noted at this point that the invention is not restricted to the especially shown design variants of the same, but instead rather various combinations of the individual design variants are possible interchangeably and these possible variants can be developed using the skill of the expert working in this area based on the teachings of technical practice through the objective invention.

Furthermore, individual features or feature combinations of the different shown and described embodiments can represent independent, inventive solutions or solutions as per the invention.

The task that forms the basis of the independent, inventive solutions can be taken from the description.

All specifications of value ranges in the objective description are to be understood in the way that they include any and all the sub-areas e.g. the specification 1 to 10 is to be understood such that all sub-areas, starting from the lower limit 1 and the upper limit 10 are included i.e. all sub-areas start with a lower limit of 1 or more and end at an upper limit of 10 or less e.g. 1 to 1.7, or 3.2 to 8.1, or 5.5 to 10.

Mainly the individual designs shown in the FIGS. 1, 2, 3, 4, 5, 6, 7 can become the object of solutions that are independent, inventive, or as per the invention. The tasks and solutions in this context as per the invention can be taken from the detailed descriptions of these figures.

As a matter of form, it must be pointed out that the extrusion machine 1 or its components have sometimes been shown as not to scale and/or magnified and/or reduced in size for a better understanding of the structure of the extrusion machine 1.

LISTING OF REFERENCE SYMBOLS

1 Extrusion machine
2 Profile
3 Extrusion material
4 Friction wheel
5 Base frame
6 Tool holding device
7 Swivel axis
8 Drive axis
9 Drive unit
10 Pinch roller
11 Locking device
12 Tool unit
13 End area
14 Setting device
15 Setting element
16 Setting surface
17 Guide area
18 Support area
19 Pressure unit
20 Pressure element
21 Pressure chamber
22 Measuring device
23 Evaluation and control unit
24 Receiving chamber
25 first positioning surface
26 second positioning surface
27 Drive shaft
28 Coupling
29 first drive shaft part
30 second drive shaft part
31 first coupling element
32 second coupling element
33 Coupling device
34 Follower ring
35 first receiving opening
36 second receiving opening
37 Support axis
38 Outer thread
39 Inner thread
40 Adjusting device
41 Connection lever
42 Receiving cage
43 first receiving cage part
44 second receiving cage part
45 Means of connection
46 Front face
47 Front face
48 Receiving channel
49 Tool element
50 Expanding channel
51 Scraping element
52 Receiving cage
53 Die
54 Molding channel
55 Profile axis
56 Support surface
57 Passage opening
58 Distancing element
59 Contact surface
60 Contact surface
61 Centering pin
62 Receiving groove
63 Groove base surface
64 Groove base surface
65 Contact areas
66 Contact areas
67 Holding unit
68 Holding unit receiving opening
69 Centering arrangement

70 Centering element
71 Centering element
72 Protrusion
73 Protrusion front face

The invention claimed is:

1. A tool unit for an extrusion machine for continuous production of profiles from a moldable extrusion material, the tool unit comprising:

an inlet side, an outlet side, a scraping element arranged on the inlet side for the moldable extrusion material, at least one tool element arranged on the inlet side, the at least one tool element comprising an expanding channel for receiving the moldable extrusion material scraped by the scraping element, a die with a molding channel for molding a profile to be produced, wherein the die is arranged in a passage direction of the moldable extrusion material and after the at least one tool element arranged on the inlet side, and wherein the expanding channel and the molding channel define a profile axis for the profile to be produced, a receiving cage comprising a first receiving cage part arranged on the inlet side and a second receiving cage part arranged on the outlet side, the first receiving cage part is connected with the second receiving cage part by a connector, the first receiving cage part comprises a receiving channel extending in the passage direction of the moldable extrusion material and receiving the at least one tool element arranged on the inlet side, the second receiving cage part comprises a receiving chamber facing and opening toward the first receiving cage part, wherein the die is received in the receiving chamber and is supported by a support surface narrowing the receiving chamber at the outlet side, a common receiving groove disposed in the at least one tool element arranged at the inlet side and in the first receiving cage part, wherein the common receiving groove comprises a first groove base surface, wherein the scraping element is inserted loosely in the common receiving groove and is supported by the first groove base surface.

2. The tool unit according to claim 1, wherein the first receiving cage part comprises a second groove base surface, wherein the first groove base surface and the second groove base surface extend toward the second receiving cage part arranged at the outlet side, wherein the scraping element comprises a first contact area mirror-invertedly aligned with the first groove base surface and a second contact area mirror-invertedly aligned with the second groove base surface.

3. The tool unit according to claim 2, wherein a holding unit is disposed at an end section of the scraping element between the first contact area and the second contact area, wherein the common receiving groove comprises a holding unit receiving opening mirror-inverted to the holding unit, and wherein the holding unit faces the second receiving cage part and engages in the holding unit receiving opening.

4. The tool unit according to claim 1, wherein the at least one tool element and the receiving channel have a form-fitting interacting peripheral geometry in a peripheral direction around the profile axis.

5. The tool unit according to claim 1, wherein the die is received and guided in the receiving chamber in an axial direction with respect to the profile axis.

6. The tool unit according to claim 1, wherein between the die and the support surface at least one distancing element is arranged.

7. The tool unit according to claim 1, wherein the first receiving cage part has a first receiving cage part front surface comprising a first centering element and the second receiving cage part has a second receiving cage part front surface facing the first receiving cage part front surface comprising a second centering element interacting with the first centering element.

8. The tool unit according to claim 1, wherein the second receiving cage part has a first contact surface at a first end at the output side, wherein the first contact surface is aligned in a plane perpendicular to the profile axis and a second contact surface disposed at an angle to the first contact surface.

9. An extrusion machine for continuous production of profiles from a moldable extrusion material, the extrusion machine comprising:

a base frame comprising a swivel axis, a drive unit, at least one friction wheel connected with the drive unit and rotatable on a drive axis, the at least one friction wheel comprising at least one peripheral groove, at least one pinch roller, a tool holding device mounted at the swivel axis on the base frame and swivelable on the swivel axis in a swivel movement between a working position and a release position, wherein the tool holding device, seen in a passage direction of a profile to be produced, is arranged after the at least one friction wheel, a locking device having a locking position wherein the locking device keeps the tool holding device locked in the working position with respect to the base frame, at least one tool unit supported at the tool holding device, a gap between the at least one tool unit and the at least one friction wheel when the tool holding device is in the working position, wherein at the base frame a setting device is arranged in an end area of the tool holding device, wherein the end area is distanced from the swivel axis and lies at a location opposite to the drive axis of the at least one friction wheel, wherein the setting device has a setting element, wherein the setting element is adjustable with respect to the base frame and has a setting surface facing the end area of the tool holding device and a guide surface facing away from the tool holding device, the tool holding device comprises a support surface at the end area, wherein the support surface is distanced from the swivel axis and is arranged at a first side facing the at least one friction wheel, wherein in the working position of the tool holding device the support surface is supported at the setting surface of the setting element, the locking device comprises at least one pressure unit with at least one pressure element arranged at the end area, wherein the at least one pressure element is distanced from the swivel axis when the tool holding device is in the working position, but is in contact with the tool holding device at a second side facing away from the at least one friction wheel, and via the at least one pressure unit the support surface of the tool holding device is pressed at the setting surface of the setting element, the gap between the at least one tool unit and the at least one friction wheel has an adjustable gap width, the gap width changed by adjusting the setting element.

10. The extrusion machine according to claim 9, further comprising a pressure chamber and a pressure medium in the pressure chamber, wherein the at least one pressure element of the at least one pressure unit is received in the pressure chamber and is exposed to the pressure medium present in the pressure chamber, wherein the pressure medium presses the at least one pressure element against the second side of the tool holding device.

11. The extrusion machine according to claim 10, wherein upon adjusting the setting element and while carrying out the swivel movement of the tool holding device on the swivel axis, a position of the at least one pressure element relative to the at least one pressure unit is adjusted through a volume change of the pressure medium in the pressure chamber.

12. The extrusion machine according to claim 9, wherein in the gap between the at least one tool unit and the at least one friction wheel a measuring device is arranged, wherein the measuring device determines the gap width and is connected with an evaluation and control device, and the evaluation and control device is connected with the setting device.

13. The extrusion machine according to claim 9, further comprising a receiving chamber built in the tool holding device, wherein the receiving chamber comprises a first positioning surface and a second positioning surface aligned at an angle to the first positioning surface, wherein the at least one tool unit is supported in the receiving chamber at both the first positioning surface and the second positioning surface, wherein in the working position of the tool holding device the first positioning surface is arranged on a side of the at least one tool unit facing away from the at least one friction wheel and the receiving chamber opens toward the at least one friction wheel.

14. The extrusion machine according to claim 13, wherein in the working position of the tool holding device the first positioning surface is aligned in a vertical direction with respect to the passage direction.

15. The extrusion machine according to claim 9, wherein the at least one tool unit comprises:

an inlet side, an outlet side, a scraping element arranged on the inlet side for the moldable extrusion material, at least one tool element arranged on the inlet side, the at least one tool element comprising an expanding channel for receiving the moldable extrusion material scraped by the scraping element, a die with a molding channel for molding a profile to be produced, wherein the die is arranged in a passage direction of the moldable extrusion material and after the at least one tool element arranged on the inlet side, and wherein the expanding channel and the molding channel define a profile axis for the profile to be produced, wherein the at least one tool unit has a receiving cage comprising a first receiving cage part arranged on the inlet side and a second receiving cage part arranged on the outlet side, the first receiving cage part is connected with the second receiving cage part by a connector, the first receiving cage part comprises a receiving channel extending in the passage direction of the moldable extrusion material and receiving the at least one tool element arranged on the inlet side, the second receiving cage part comprises a receiving chamber facing and opening toward the first receiving cage part, wherein the die is received in the receiving chamber and is supported by a support surface narrowing the receiving chamber at the outlet side, a common receiving groove disposed in the at least one tool element arranged at the inlet side and in the first receiving cage part, wherein the common receiving groove comprises at least one groove base surface, wherein the scraping element is inserted loosely in the common receiving groove and is supported by the at least one groove base surface.

16. The extrusion machine according to claim 9, wherein the drive unit of the at least one friction wheel includes a first drive shaft part arranged on a first side of the at least one friction wheel and a second drive shaft part arranged on a second side of the at least one friction wheel, wherein the first drive shaft part and the second drive shaft part is rotatably mounted on the base frame, wherein at least one of the first and second drive shaft parts can be adjusted in an axial direction with respect to the base frame from a contact position lying adjacent to the at least one friction wheel to an alternate position distanced from the at least one friction wheel.

17. The extrusion machine according to claim 16, wherein the at least one friction wheel lies adjacent to the first and second drive shaft parts and is held clamped in the axial direction between the first and second drive shaft parts.

18. The extrusion machine according to claim 16, further comprising a coupling device comprising interacting first coupling elements and second coupling elements connecting the at least one friction wheel with at least one of the first and second drive shaft parts so as not to rotate.

19. The extrusion machine according to claim 18, wherein at least one of the first and second drive shaft parts has a follower ring facing the at least one friction wheel, and the first coupling elements are disposed at a ring front surface of the follower ring.

20. The extrusion machine according to claim 18, wherein the first drive shaft part has a first follower ring with a first ring front surface and the second drive shaft part has a second follower ring with a second ring front surface distanced from the first ring front surface in a direction of the drive axis, and wherein the at least one friction wheel comprises the second coupling elements arranged offset to one another in a peripheral direction on both the first and second ring front surfaces.

21. The extrusion machine according to claim 16, wherein the first drive shaft part comprises a central cylinder-shaped first receiving opening and the second drive shaft part comprises a central cylinder-shaped second receiving opening aligned with the first receiving opening, wherein a common support axis is integrated in the first and second receiving openings.

22. The extrusion machine according to claim 21, wherein the support axis comprises an outer thread at a first axis end area facing the first drive shaft part, wherein the first receiving opening of the first drive shaft part comprises an inner thread screw-connectable with the outer thread.

23. The extrusion machine according to claim 22, wherein the support axis is displaceable from a working position wherein the support axis is in contact with the at least one friction wheel and wherein the support axis is connected with the inner thread of the first drive shaft part in the axial direction to an extent that the first axis end of the support axis facing the first drive part shaft is arranged outside of the at least one friction wheel.

24. The extrusion machine according to claim 21, wherein the support axis is slidably mounted in the second receiving opening.

25. The extrusion machine according to claim 16, wherein the second drive shaft part is adjustable together with the support axis present in the second drive shaft part in the axial direction from the contact position in the alternate position.

* * * * *